US005365717A

United States Patent [19]

McKinlay

[11] Patent Number: 5,365,717

[45] Date of Patent: Nov. 22, 1994

[54] EGG PACKER APPARATUS

[76] Inventor: Bruce A. McKinlay, R.R. #3, Ridgetown, Ontario, Canada, N0 2C0

[21] Appl. No.: 66,086

[22] PCT Filed: Nov. 26, 1991

[86] PCT No.: PCT/CA91/00419

§ 371 Date: Jul. 26, 1993

§ 102(e) Date: Jul. 26, 1993

[87] PCT Pub. No.: WO92/09483

PCT Pub. Date: Jun. 11, 1992

[30] Foreign Application Priority Data

Nov. 26, 1990 [GB] United Kingdom ..... 9025639

[51] Int. Cl.[5] ..... B65B 23/06

[52] U.S. Cl. ..... 53/111 R; 53/142; 53/246; 53/251; 53/534; 53/544

[58] Field of Search ..... 53/544, 534, 158, 251, 53/250, 249, 246, 244, 143, 142, 111 R, 55

[56] References Cited

U.S. PATENT DOCUMENTS

| | | | |
|---|---|---|---|
| 2,855,740 | 10/1958 | Noland, Jr. et al. | 53/534 X |
| 3,311,216 | 3/1967 | Jones | 53/534 X |
| 3,316,688 | 5/1967 | Niederer et al. | 53/544 X |
| 3,722,173 | 3/1973 | Noguchi | 53/534 X |
| 3,820,301 | 6/1974 | Willsey | 53/534 X |
| 4,189,898 | 2/1980 | Moulds et al. | 53/544 X |
| 4,575,993 | 3/1986 | Meyn | 53/544 X |
| 4,730,440 | 3/1988 | Jelle van der Schoot et al. | 53/544 X |
| 4,733,518 | 3/1988 | Griesdorn | 53/534 X |

FOREIGN PATENT DOCUMENTS

WO9209483 6/1992 WIPO .

OTHER PUBLICATIONS

Notification of Transmittal of Inter'l Preliminary Exam Report for PCT/CA91/00419.

*Primary Examiner*—James F. Coan

*Attorney, Agent, or Firm*—Vidas, Arrett & Steinkraus

[57] ABSTRACT

An egg packer apparatus is disclosed having baskets mounted on a transport moveable in a continuous path. The baskets have side-by-side compartments and move from an upright loading position to an inverted position at an unloading station. In the inverted position, the eggs roll along a cover to provide lateral movement of each egg in the direction of its pointed end. The unloading station has chutes to receive only the blunt end half of the egg as it rolls along. The egg drops into the chute blunt end first and then topples forwardly down the chute and drops pointed end downwardly into the egg flat.

20 Claims, 8 Drawing Sheets

EGG PACKER APPARATUS

FIELD OF THE INVENTION

This invention relates to egg packing apparatus for orienting and packing eggs on a flat.

BACKGROUND OF THE INVENTION

Egg packers have been used for many years to pack eggs in appropriate containers. The container may be what is generally known as a flat which receives a relatively large number of eggs, for example five rows each containing six eggs for a total of thirty eggs, or may be a carton which usually contains two rows each containing six eggs for a total of a dozen. A flat has upwardly open separated egg receiving compartments, and flats can be stacked vertically one upon another. Flats are used to transport eggs in large numbers from the producer to the wholesaler. Cartons also have upwardly open separated egg receiving compartments, but also have a lid to cover the eggs, and can also be stacked. Eggs are packed in cartons by a wholesaler for transportation to a retailer and eventual purchase by a consumer.

Eggs are fragile and care has to be taken to minimize breakage. Also, it is common practice to pack eggs with their pointed ends down, that is to say with their blunt ends uppermost. It is the blunt ends which contain the air sac. Two major requirements of an egg packer apparatus therefore are that it handles eggs carefully to minimize breakage and is also capable of orienting eggs from an horizontal orientation to a vertical orientation with pointed ends lowermost. Many different types of egg packer apparatus have been used over the years, but each have their inherent shortcomings.

The present invention utilizes the fact that, when an egg in a horizontal orientation is caused to roll along a surface, it tends to move laterally in the direction of its pointed end. This phenomena can be applied in an egg packer or egg conveying apparatus for simply moving eggs from one place to another.

This phenomena is used, for example, in U.S. Pat. No. 3,592,327 (Koch et al) issued Jul. 13, 1971, U.S. Pat. No. 3,964,233 (Thomas) issued Jun. 22, 1976, U.S. Pat. No. 4,189,898 (Moulds et al) issued Feb. 26, 1980. However, the apparatus described therein still require an additional egg conveying apparatus to utilize this principle. This increases the likelihood of egg breakage.

The present application discloses an egg packer apparatus having a basket means mounted on a transporting means movable in a continuous path with a series of egg receiving compartments one behind the other, each compartment is substantially tubular having a front edge, a rear edge, and a pair of laterally-spaced side walls;

means at a loading station for feeding eggs into the compartments to cause each compartment to receive one egg, said transporting means operating to move each compartment from the loading station to an unloading station where each egg falls by gravity from its compartment;

a cover means providing each compartment with a bottom surface at least during a portion of the path between the loading and unloading stations when said basket means is inverted to thereby cause the egg in the compartment to be engaged by the rear edge of the compartment and thereby caused to roll over the said bottom surface to provide lateral movement of the egg in the direction of its pointed end until the pointed end engages or nearly engages an adjacent side wall of the compartment, and means at the unloading station to receive the egg from each compartment with the pointed end of the egg is engaging one side wall of the compartment or the laterally opposite side wall of the compartment.

There is further disclosed an apparatus having an egg receiving means at the unloading station comprising a chute located so as to be positioned substantially between the side walls of a compartment as the compartment reaches the unloading station, said chute having side walls which are spaced apart by distance to receive only the blunt end half of the egg as it drops from the compartment to cause the egg to drop into the chute blunt end downwardly whether the pointed end of the egg is engaging one side wall of the compartment or the laterally opposite said wall of the compartment. The chute has a free front end from which the egg drops to a further egg receiving means, and the length of the chute is sufficient to enable the egg, after having been received blunt end downwardly to topple forwardly to a position in which its pointed end faces forwardly down the chute and drops pointed end downwardly from the free end of chute into the further egg receiving means.

The transporting means may have one or more side-by-side series of compartments, with said egg receiving means including one of said chutes for each series of compartments, said chutes being side-by-side and each positioned to receive an egg from a corresponding compartment in each series.

The transporting means may have alternate first and second series of said compartments one behind the other or if desired, the compartments in each first series being staggered transversely relative to the compartments in each second series, and the egg receiving means having corresponding first and second sets of chutes, the chutes of the second set being interposed between the chutes of the first set in alternating relationship.

The further egg receiving means may comprise egg receiving compartments travelling at a predetermined speed relative to the speed of the transporting means, and the chutes in the second set having front ends forwardly of those of the chutes in the first set to cause eggs from a first set of compartments dropping from the first set of chutes to be received in transversely alternate compartments of the further egg receiving means when said compartments are at one position, and to cause eggs from a second set of compartments dropping from the second set of chutes to be received in compartments of the further egg receiving means which are transversely intermediate said alternate compartments when the compartments are at a different position.

The rear edge of each compartment may form egg toppling means which engage the uppermost pointed end of an egg in the chute, after the egg has fallen from the compartment into the chute with the blunt end of the egg downwardly, to cause the egg to topple forwardly to said position in which its pointed end faces forwardly down the chute. The egg toppling means may remain in engagement with the egg after said toppling to move the egg down the chute and cause the egg to drop pointed end downwardly from the free end of the chute into the further egg receiving means.

DETAILED DESCRIPTION OF THE DRAWINGS

Embodiments of the invention will now be described, by way of example, with reference to the accompanying drawings, of which:

DETAILED DESCRIPTION OF THE INVENTION

Figure 1:
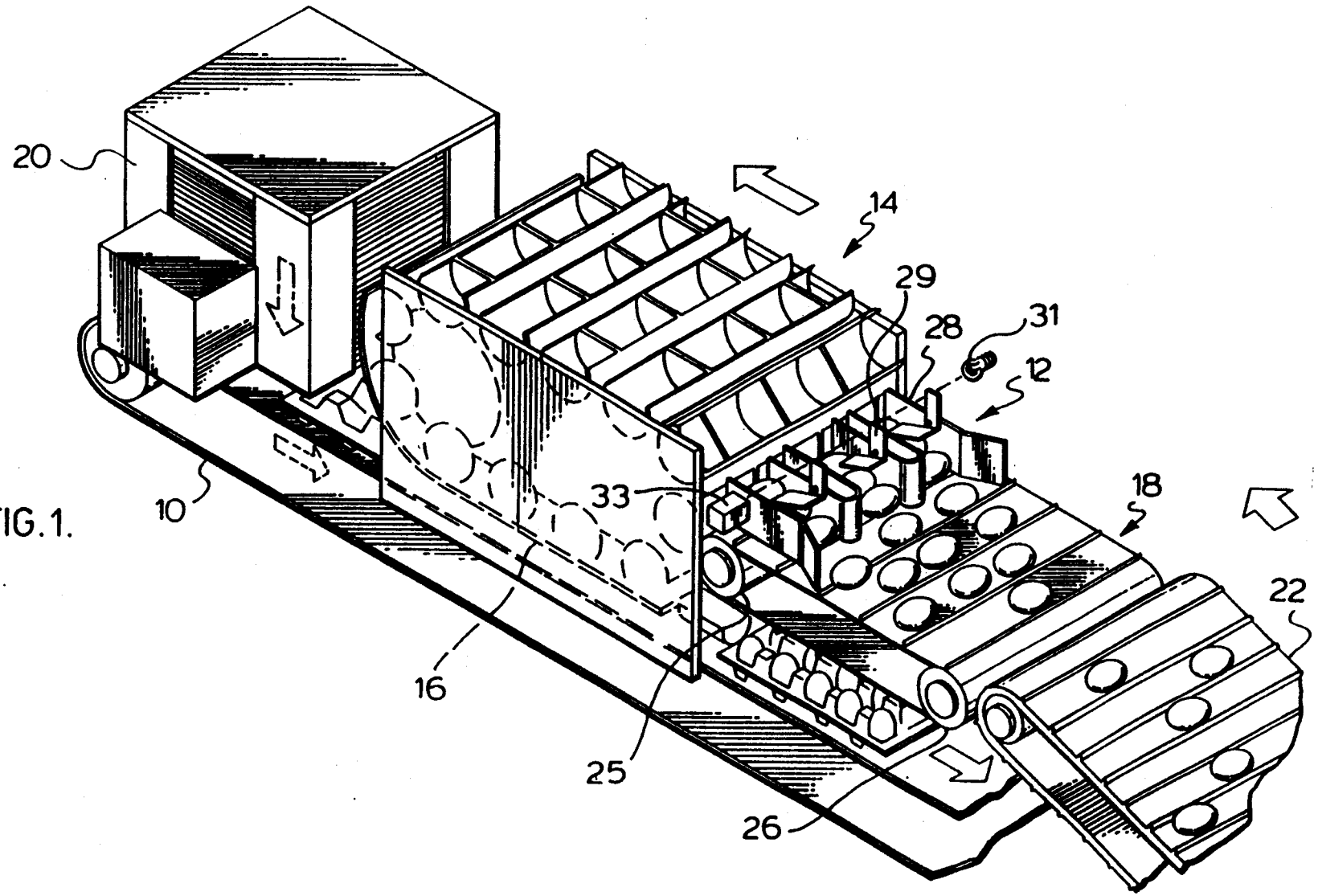
FIG. 1 is a perspective view of an egg packer apparatus in accordance with the preferred embodiment of the present invention.

Referring to FIG. 1, the egg packer apparatus according to the present invention generally comprises a flat delivery conveyor 10, an egg loader 12, an egg transport 14, an egg orientor 16, a slat conveyor 18, a flat denester 20. The egg apparatus is fed with eggs from a rod conveyor 22 which transports eggs from the hen house to the packer.

The slat conveyor 18 is rotated by sprockets 25 and 26 which are mechanically rotated by an electric motor. Slat conveyor 18 is positioned to receive eggs from the rod conveyor 22. A ledge is provided so that the eggs roll gently from the rod conveyor 22 to the slat conveyor 18.

Figure 3:
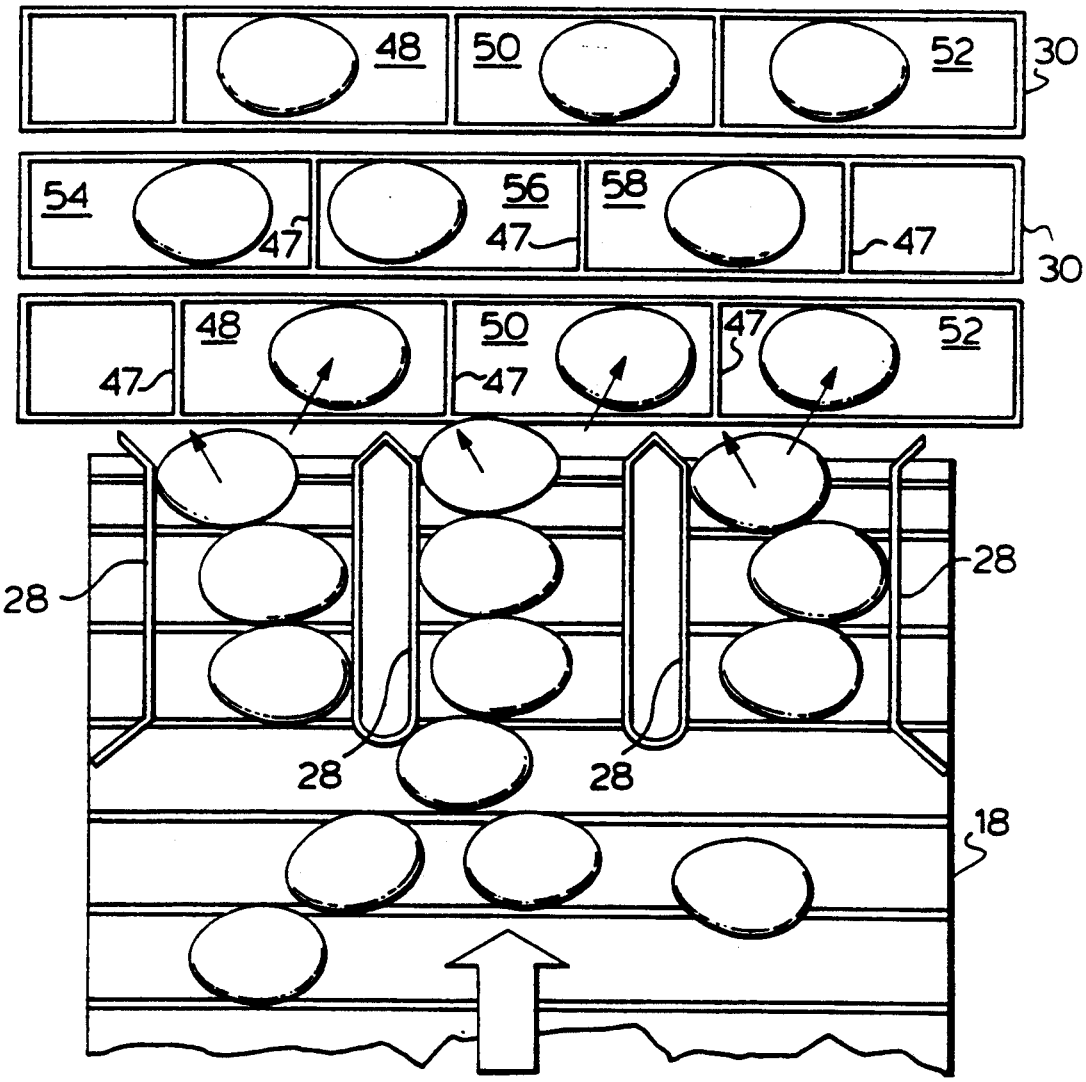
FIG. 3 is a top plan view of the embodiment of FIG. 1 illustrating the loading of the eggs onto the egg transport.

Referring to FIG. 3, at the downstream end of the slat conveyor 18, egg loader 12 is mounted thereabove. Egg loader 18 comprises a series of guides 28 which are in line with the travel of the slat conveyor to divide the flow of eggs into a number of eggs in single file.

Pivotally mounted between each guide are flaps 29. Each flap 29 has a lower portion and a block portion. The lower portion rests in the flow of the eggs as they pass through the guide 28 in single file. The block portion extends upwardly to block a beam of light of an optical sensor having a projector 31 mounted on one side of the slat conveyor 18 and a receiver 33 mounted on the other side.

Figure 2:
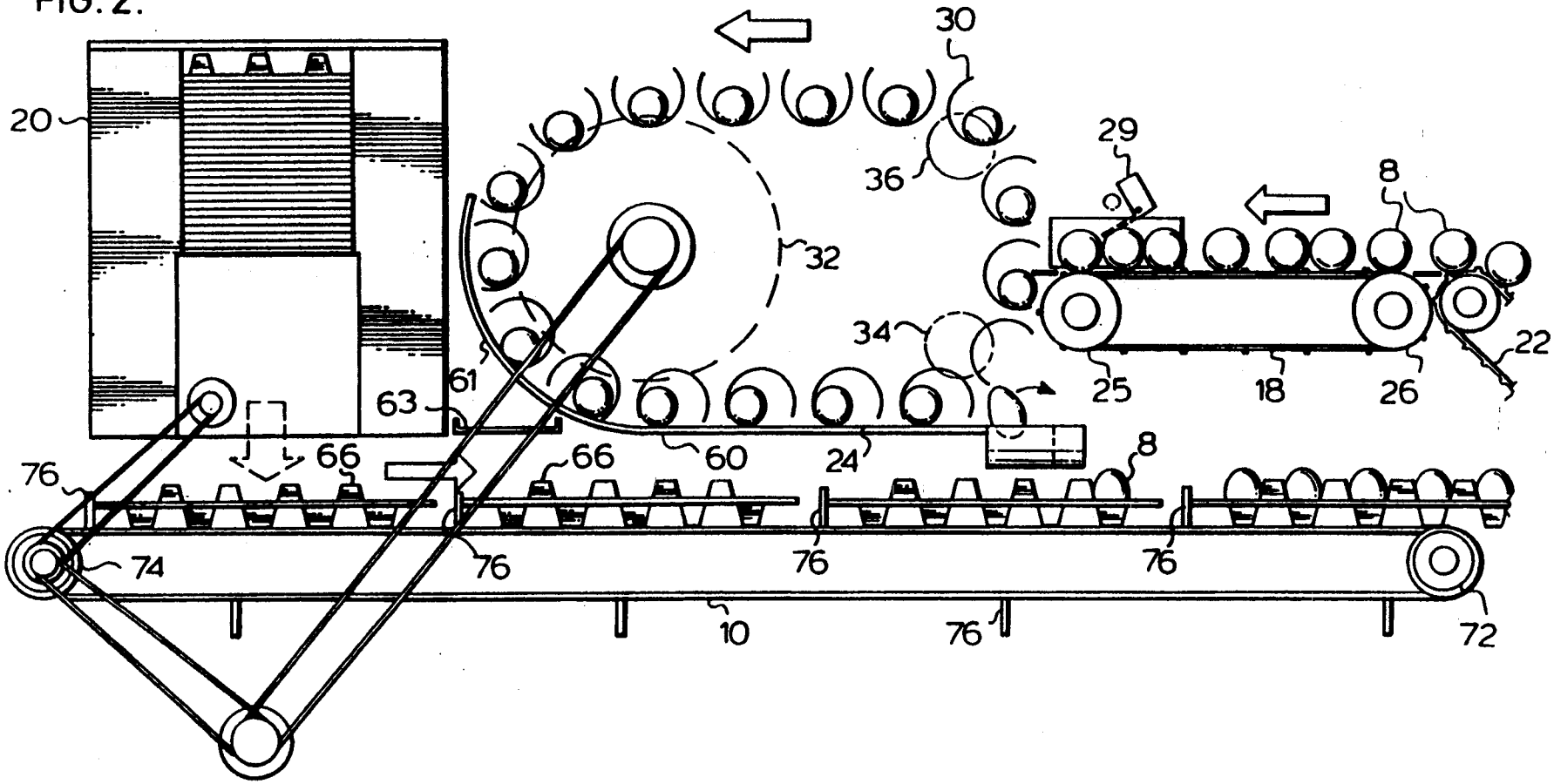
FIG. 2 is a diagrammatic side view of the embodiment of FIG. 1 illustrating the progression of eggs through the apparatus.

Referring first to FIG. 2, the egg transport 14 comprises egg baskets 30 mounted between endless chains and driven by a suitable electric motor. The endless chains are mounted on large sprocket 32 and two small sprockets 34 and 36 defining an endless path of travel extending firstly substantially horizontal, then arcuately about large sprocket 32 and then inverted and finally vertical at the loading station.

Figure 4:
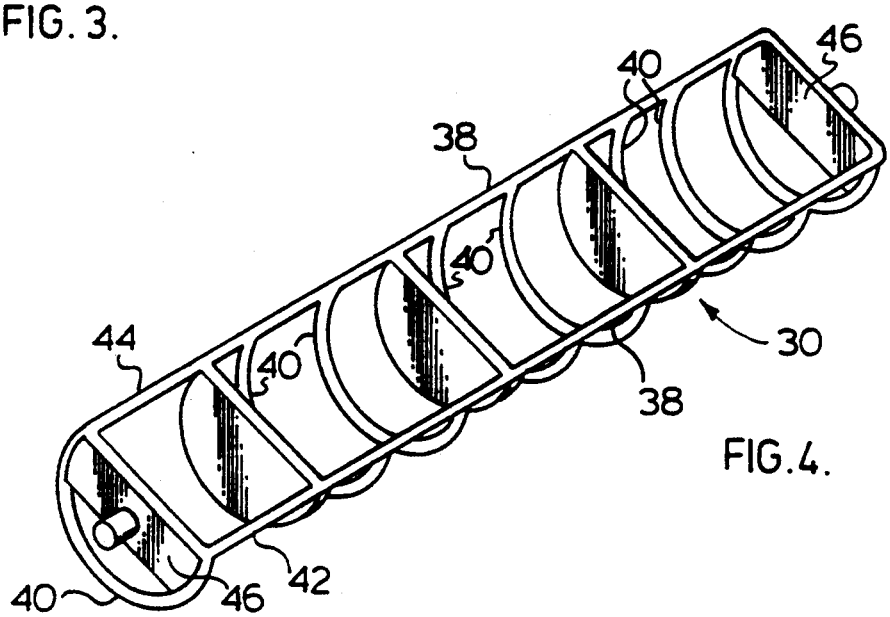
FIG. 4 is a perspective view of the basket of the egg packer apparatus of FIG. 1.

Referring to FIG. 4, each basket 30 has longitudinally extending ribs 38 and circumferentially extending ribs 40. Basket 30 is substantially tubular in cross section with a chordal opening provided for receiving eggs defined by a front edge 42, a rear edge 44 and a pair of laterally-spaced side walls 46 and defining a D-shape in cross section.

Each basket 30 has three side-by-side series of egg receiving compartments 48, 50, 52 defined by side walls 47. The compartments 48, 50, 52 of each series are alternately staggered as shown in FIG. 3, so that alternate compartments 54, 56, 58 are peripherally aligned with each other and adjacent rows of compartments are staggered relatively to each other, with adjacent row of compartments transversely overlapping over about half their width.

Each basket has a width approximately equal to 3½ compartments such the adjacent endless chains may be uniformly spaced. The baskets are fixedly joined to the chains by any suitable means. The baskets are fixed preferable in an eccentric manner as illustrated in FIG. 2 whereby the opening is upward during the first horizontal portion of the path of travel and downward in the inverted portion at the unloading station and substantially horizontal in the vertical portion at the loading station.

At the end of slat conveyor 18 is the loading station. A ledge is provided so that the eggs roll gently from the slat conveyor 18 to the baskets 30.

An arcuate cover 60 presenting an egg rolling surface 24 extends part way around the exterior of the path from sprocket 32 about the inverted portion of the path of travel to prevent the eggs from leaving the compartments 48, 50, 52, 54, 56, 58 until desired. Cover 60 has a width equivalent to the width of baskets 30. Cover 60 has an arcuate surface 61 made of a perforated plastic which is spaced relatively close to the egg receiving opening of each basket 30 near sprocket 32 and gradually increases permitting an egg to roll from the compartment onto the rolling surface 24 to roll therealong and be pushed by edge 44 of basket 30.

Arcuate surface may also be made of a coated wire mesh to allow debris on the eggs to fall from the egg. A tray 63 is mounted to catch the fallen debris.

Figure 5:
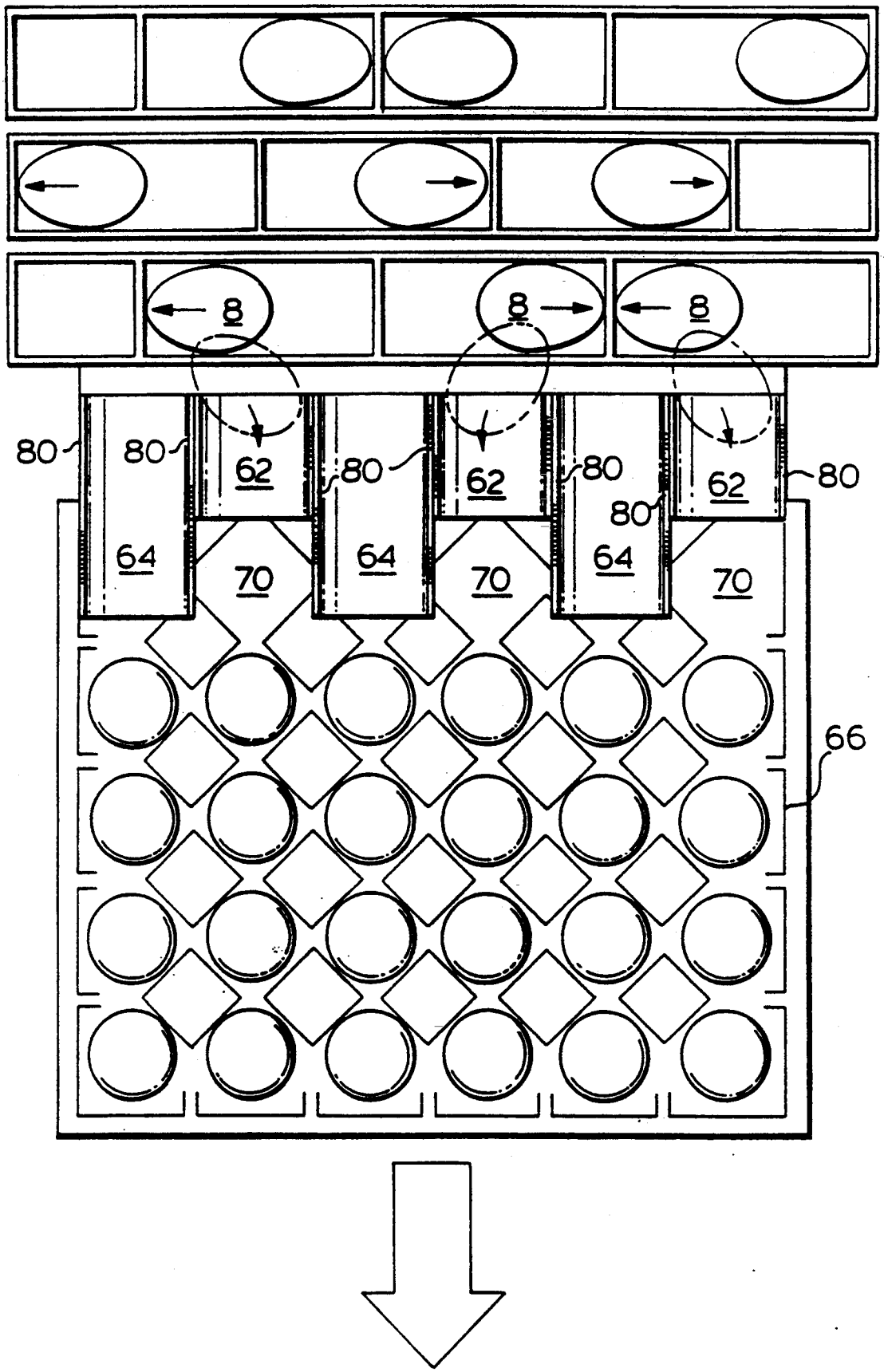
FIG. 5 is a top plan view of the unloading station of the embodiment of FIG. 1 illustrating the eggs being unloaded onto egg flats.

Referring to FIG. 5, six side-by-side chutes 62 and 64 are positioned at the end of rolling surface 24 for feeding eggs 8 from the basket 30 into a transportable receptacle or flat 66 passing below the basket 30 on a conveyor 10. Each chute 62 and 64 preferably has an egg receiving end 68 which is rounded to receive the rolling egg in a manner to prevent damage to the egg.

Each flat 66 may be of the conventional kind with five longitudinally-spaced transversely-extending rows of egg receiving compartments 70, there being six compartments 70 in each row so that each flat 66 has a total of 30 egg-receiving compartments 16. The speeds of the basket 30 and conveyor 37 are synchronized in a manner which will be clearly apparent from the following description.

The six chutes are alternatively longer and shorter, with there being longer chutes 64 and shorter chutes 62. The longer chutes 64 are positioned to receive eggs 8 from each alternate set of compartments 48, 50, 52, and the shorter chutes 62 are positioned to receive eggs 8 from each intervening staggered set of compartments 54, 56, 58.

Flat conveyor 10 is mounted immediately below the egg transport on sprockets 72 and 74. The conveyor has dividers 76 extending outwardly to push the flat along and to position the flat with respect to time for synchronization.

Denester 20 is mounted at the upstream end of flat conveyor 10 and operates to deposit a flat when an open spot on the conveyor is available. Denester 20 can be any commercially available denester suitable to handle the type of transportable egg receptacle being used.

In operation, eggs 8 are deposited onto rod conveyor 22. The rod conveyor can be part of an automated egg harvesting apparatus. Eggs 8 are rolled onto the slat conveyor 18 and will travel downstream towards guides 28 which will separate the eggs into single file lines of eggs. Eggs pass through the guides and are loaded into the compartments. Endless slat conveyor 18 feeds eggs 8 in random orientation to the basket 30 so that each compartment receives an egg in a sideways horizontal orientation as shown in FIG. 3.

Flaps 29 will be pushed out of the way if eggs are lined up to get into the compartment. The blocking portion will be pivoted out of the path of the light beam. When all three flaps are pivoted and hence all three compartments contain an egg, then the light beam will be completed generating a signal allowing the egg transport to continue advance the baskets in synchronization.

The next basket is advanced presenting three new compartments to be filled. These baskets are filled and the process repeated until all baskets in a group is full. The group of baskets will then travel along the path of the transport means.

As the eggs 8 travel in their compartments around a path, they will start to become inverted as the baskets pass the mid-height of sprocket 32. The eggs will roll toward the rolling surface 24 as the baskets travel about the circumference of the sprocket 32 until the baskets are in the inverted portion of travel. The eggs will roll over the rolling surface 24 and, in accordance with known principle, they shift laterally in the direction of their pointed ends until they engage or nearly engage an adjacent side wall 47.

As shown at the bottom of FIG. 5, three eggs 8 in a transverse row approaching the chutes 62 and 64 will have their blunt ends in the middle of their respective compartments regardless of the lateral direction in which their pointed ends are facing. The blunt ends of the three eggs 8 drop gently into a respective one of the shorter chutes 62, which are positioned for this purpose.

Figure 6:
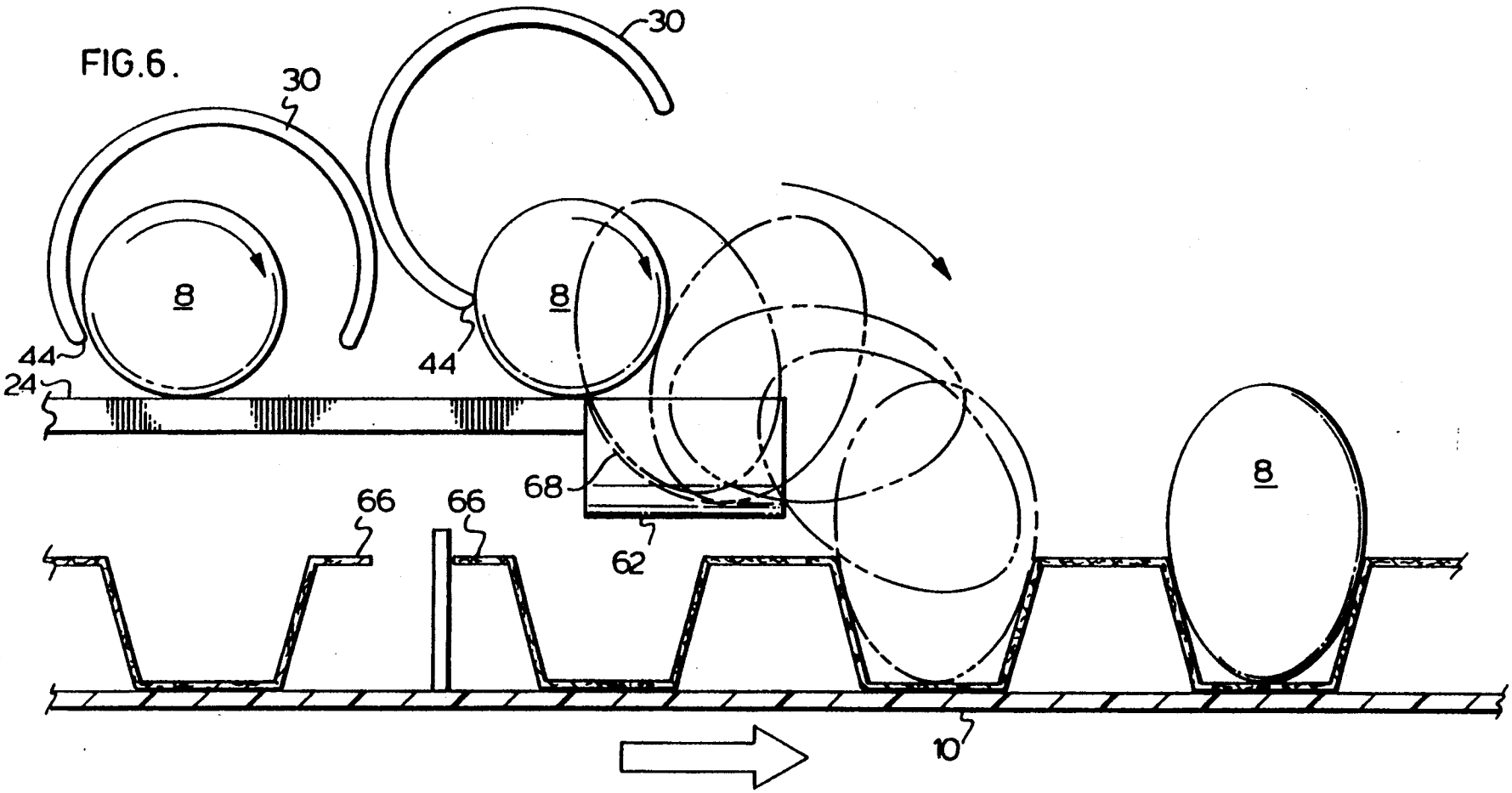
FIG. 6 is a side view of the unloading station of FIG. 5 illustrating an egg rolling onto a chute and rolling with its pointed end forward into a compartment of an egg flat.

As illustrated in FIG. 6, the small amount of momentum imparted to the eggs 8 by this movement causes the eggs 8 to topple forwardly so that their pointed ends are facing down the chutes 62. The rear edges 20 of the compartments may engage the blunt ends of the eggs 8 in the chutes 62 (and may have previously engaged the pointed ends to cause the toppling) to push them down the chutes 62 until the eggs 8 drop gently pointed ends first from the ends of the chutes 62 and into positioned compartments 70 in the flats 66 travelling on conveyor 10.

The eggs 8 which fall from one set of compartments on the basket 30 are deposited pointed end downwardly in three spaced egg receiving compartments 70 in a row of six in a flat 66 which is travelling beneath the basket 30 on conveyor 10. The three eggs which fall from the next set of compartments on the basket 30 are deposited pointed end downwardly in the alternate three compartments 70 in the row on the flat 66. The longer chutes 64 are longer than the chutes 62 by an amount which is coordinated with the speed of travel of the flat 66 so that the three eggs 8 passing down longer chutes 64 are deposited in the same row in the flat 66 as the eggs 8 which have previously passed down shorter chutes 62.

The next three eggs in the following row of baskets, which leave basket 30 are laterally staggered relative to the previous three eggs 8, and thus drop blunt end first into the shorter chutes 62 which are positioned intermediate longer chutes 64. These eggs 8 then tip forwardly and are pushed by the compartment rear edges 20 off the ends of the chutes 62 so that they drop gently from chutes 62 into their egg receiving compartments 70 in the flat 66, these compartments 70 being in the row behind and laterally intermediate their compartments 70 into which the previous three eggs 8 were deposited, as will be understood from the explanation given above with respect to the effect of the chutes 62 and 64 of different lengths.

The flat conveyor 10 is advanced in synchronization with the egg transport such that the next two series of baskets will fill the next row of receptacles in the flat. For a standard 6×5 flat ten baskets are necessary to fill a flat.

As is evident, the egg transport must be synchronized with the flat conveyor and flat denester. In order to achieve synchronization the egg transport and the flat conveyor is driven by a single electrical motor coupled together by a timing chain and gears. The motor is provided with a clutch to engage and disengage the drive in accordance with the supply of eggs. The motor is responsive to the signal generated by the light sensor to discontinue drive if no signal is received and hence no eggs are being delivered to the egg transport. If signal is being received, the drive is engaged at regular timed intervals to allow time for the eggs to be loaded into the compartments and for the eggs to roll down the chute.

Figure 9:
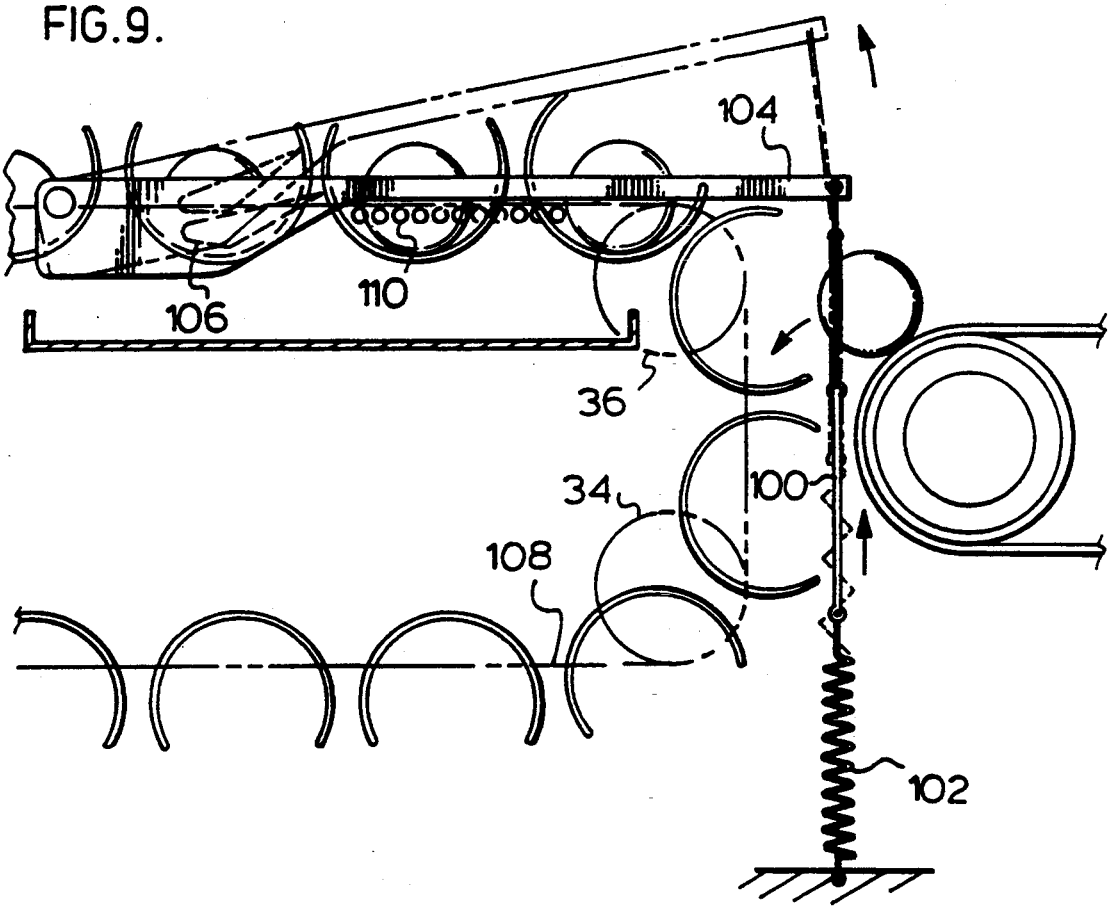
FIG. 9 is side elevational view of the embodiment of FIG. 1 illustrating the egg stopper mechanism for stopping the flow of eggs to the baskets.

Referring to FIG. 9, the synchronization can be accomplished by providing an egg blocking mechanism to stop the flow of eggs from the slat conveyor to the baskets. Plate 100 is mounted at the loading station at the end of the slat conveyor 18. Plate 100 is mounted on coil springs 102 which is mounted to the frame of the apparatus on each side of the conveyor. On the horizontal section of the egg transport a pair of rods are pivotally mounted. On the lower edge of rods 104, cams 106 are mounted. On the outside surface of the endless chains 108 which drive the egg transport are rollers 110. The rollers 110 are spaced on the endless chains to synchronize the flat conveyor with the delivery of the eggs. The baskets 30 are spaced along the endless chains 108 to deliver eggs to the flats.

The plate 100 is normally lowered out of the path of the flow of eggs The rollers 110 will advance as endless chains 108 advance and will raise the rods 104, raising plate 100 into the path of the flow of eggs thereby stopping same.

Alternatively, baskets having no opening or a plate covering the opening could be used to prevent eggs from being transported and thereby preventing eggs to be delivered to the flat when a flat is not ready to receive eggs, i.e. between flats.

As shown in FIG. 5, the edges 80 of chutes 62 and 64 may be of a relatively flexible material. Flexible edges on the chute allows the eggs to tip into the chute more easily. Such material allows the chute to receive eggs larger in circumference than the curve of the chute and the weight of the eggs will center it within the chute, enveloping it on three sides. Further the egg receiving end 68 of the chutes are rounded to reduce to impact of the egg rolling from the rolling surface 24.

The apparatus as described requires only three eggs across to fill a standard 6×5 flat. This allows the apparatus to be manufactured to a width of the same order as the width of a standard flat thereby reducing the space requirements for installation of the apparatus or alternately, ganging two or more like devices together side by side increasing the egg packing capacity.

The apparatus could be modified to accommodate a standard egg carton containing 2×6 or 2×5 eggs. The number of compartments in each basket is reduced to one with the number of baskets in a group being either 30 or 10 respectively.

Figure 7:
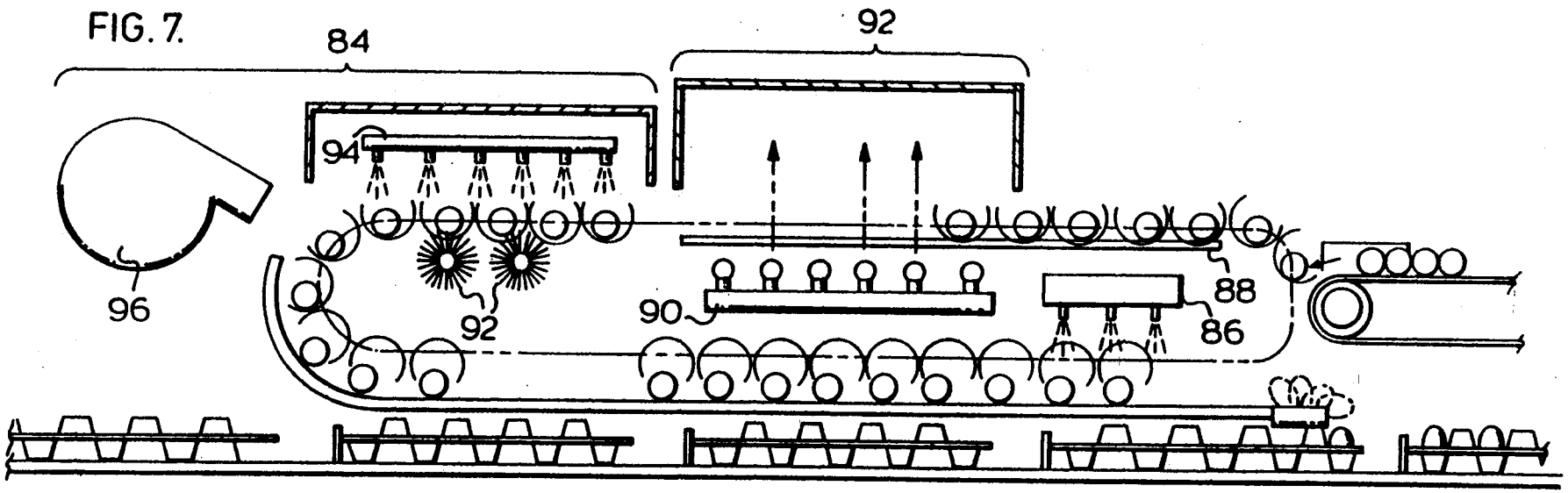
FIG. 7 is a diagrammatic side of view of the embodiment according to FIG. 1 with an egg washer, egg candler and egg oiler.

Further, as illustrated in FIG. 7, the apparatus could be configured to include other accessories. The horizontal portion and the inverted portion of the path of travel of the baskets 30 could be increased and elongated allowing more time in these orientations. A egg candler 82, egg washer 84 and an egg oiler 86 could be added to increase the utility of the apparatus. An added benefit of this arrangement is that more than one group of baskets may be incorporated into the egg transport thereby increasing the efficiency and speed of operation of the apparatus.

For an egg candler, three flat surfaces 88 are placed in the horizontal portion of the path. The flat surfaces will one end which is tangential to the baskets and the other end slightly higher and raising the eggs from the bottom of the baskets causing them to roll along. The flat surfaces are narrower than the width between the circumferential ribs 40. Lights 90 are mounted under the path for illuminating the eggs as they roll along the flat surface.

For an egg washer 84, scrub brushes 92 are rotatably mounted beneath the path of the egg transport and wash sprays 94 are mounted above the egg transport with an air dryer 96 mounted downstream. The scrub brushes 92 will scrub and rotate the eggs with the aid of the spray 94 to fully clean each egg.

An egg oiler spray 86 may be installed above the inverted portion-of the path to spray the eggs immediately prior to being rolled onto the flats.

A timer mounted on the guides having a flap extending into the flow of eggs may also provided. As eggs pass under the flap and holds the flap up, a new timing cycle is initiated. If the flap and the timing cycle reaches the end of a pre-determined time period, then the rod conveyor will temporarily shut off to stop the flow of eggs to the slat conveyor allowing the baskets to fill and reduce the backlog of eggs on the slat conveyor. Once the flap returns to its rest position after the backlog of eggs on the slat conveyor has passed, the rod conveyor is re-started delivering eggs to the slat conveyor.

Figure 8:
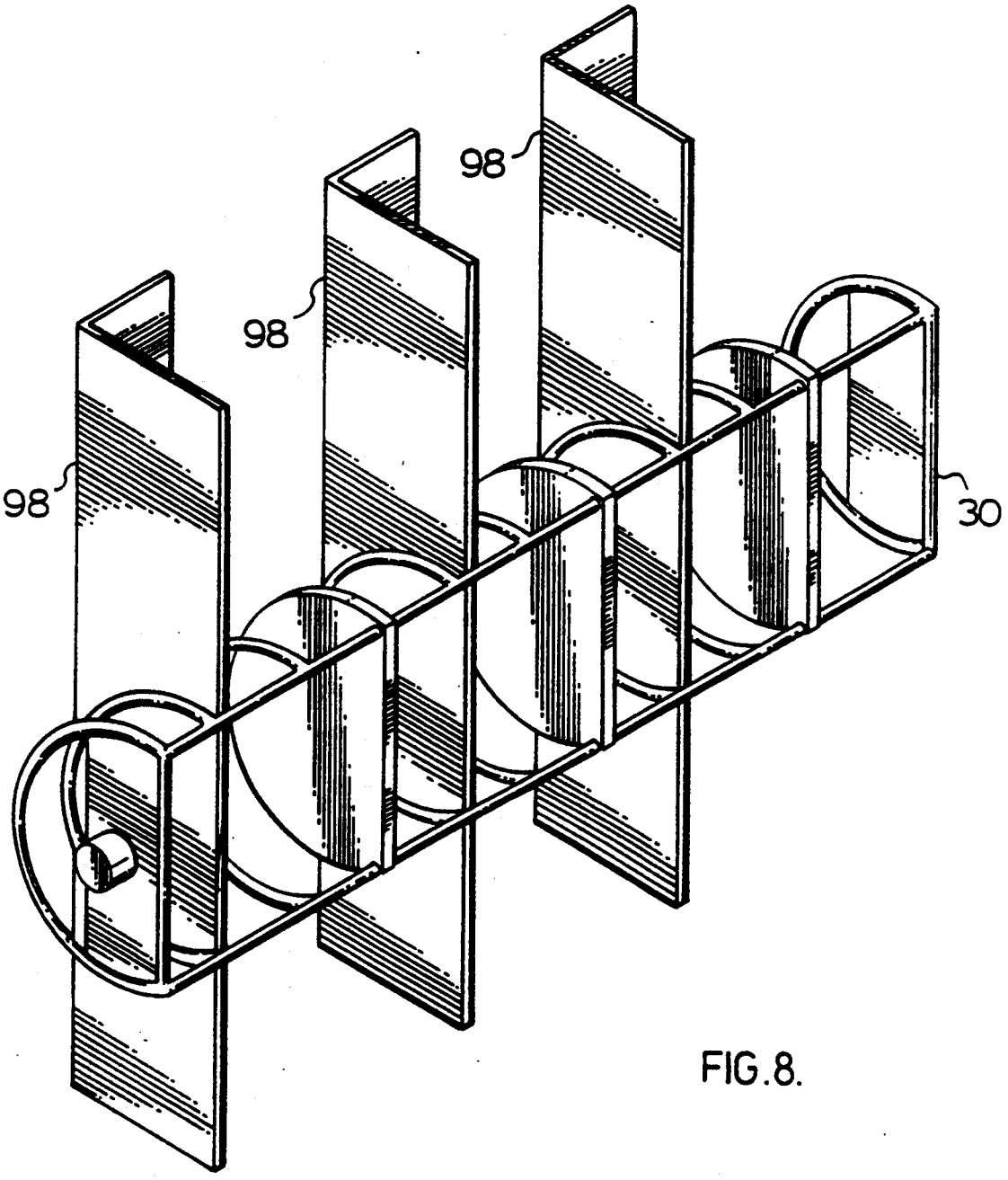
FIG. 8 is a perspective view of optional baffles for the embodiment of FIG. 1.

Referring to FIG. 8, a further feature could be added to increase the loading speed of the egg packer apparatus of the present invention. Baffles 30 could be installed at the loading station to reduce the apparent size of the compartments as they each pass the loading station at the end of the slat conveyor 18. The compartments are large enough to hold two eggs and therefore the baffles 30 will direct one egg 8 into one end of compartment thereby reducing the likelihood of breakage.

Figure 10:
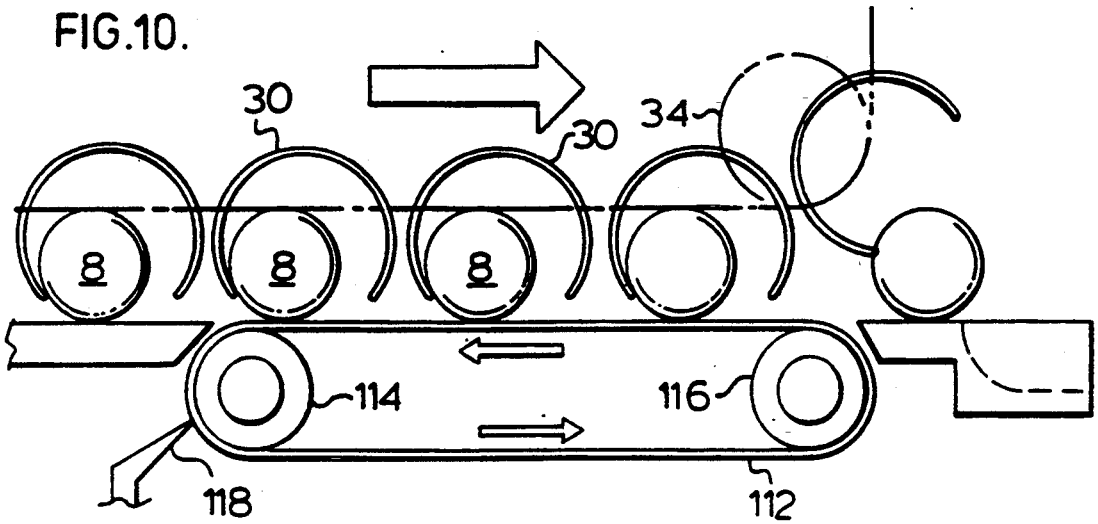
FIG. 10 is a side elevational view of egg unloading station of the embodiment of FIG. 1 with an optional conveyor.

Referring to FIG. 10, a further option could be added to increase the speed at which the eggs roll to one side of the compartment towards the pointed end. A counter-rotating conveyor 112 mounted on sprockets 114 and 116 could be added to rolling surface 24. The upper surface of the conveyor will rotate in a direction opposite the movement of the eggs increasing the effective surface for rolling the eggs. A scraper 118 cleans the surface of the conveyor.

The baskets 130 can be reduced in height by having the bottom of the basket flattened in comparison with basket 30. The reduced height reduces the movement of the eggs and thereby reduces the possibility of breakage during packing.

The advantages of the invention will be readily apparent to a person skilled in the art from the foregoing description of preferred embodiments.

I claim:

1. An egg packing apparatus for orienting and transferring eggs from a loading station to an unloading station for depositing eggs in a transportable receiving means (66), said apparatus comprising, a first endless conveyor means (18) for receiving and delivering eggs to the loading station, a plurality of basket means (30) for receiving eggs from said first endless conveyor (18) at the loading station and cradling said eggs during transport from the loading station to the unloading station along a path, said basket means (30) spaced one behind the other and each basket means having a pair of laterally-spaced side walls and an egg receiving opening, loading means (28) for directing eggs from said endless conveyor means (18) into the basket means (30) to cause each basket means to receive a predetermined number of eggs, said basket means mounted on a transport means operating to orient and move each basket means along said path, an egg rolling surface (24) extending along the path as the transport means orients the basket means from a cradling upright position to and during an inverted position, said egg rolling surface (24) spaced from the basket means while in an inverted position whereby the basket means pushes the egg to roll the egg over the said egg rolling surface to provide lateral movement of the egg in the direction of its pointed end, a chute (62, 64) at the end of the egg rolling surface (24) and aligned to receive the blunt end of said egg, said chute having a length whereby the egg will roll off the chute orienting the egg, a second endless conveyor means (10) for moving said transportable receptacle (66) under said chute for receiving said egg as it rolls from the chute, drive means for driving said transport means and said first and second conveyor means, and timing means for synchronising the movement of the transport means with the second conveyor means whereby the transportable receptacle (66) is positioned to receive said eggs as it rolls from said chute.

2. An egg packing apparatus as claimed in claim 1 wherein said basket means (30) comprises a plurality of compartments (48, 50, 52 or 54, 56, 58), said basket means comprising an alternating series of first baskets followed by second baskets, said first baskets having compartments staggered transversely relative to the compartments in the second baskets, and the unloading station having a first and second sets of chutes (62, 64), the chutes of the second set being interposed between the chutes of the first set in alternating relationship and corresponding to receive eggs from said first and second baskets.

3. An egg packing apparatus as claimed in claim 2 wherein said loading means includes guide means (28) for aligning eggs one after another.

4. An egg packing apparatus as claimed in claim 3 wherein said chutes in the second set (64) have front ends forwardly of those of the chutes in the first set (62) to cause eggs from a first set of baskets rolling from the first set of chutes to be received in alternate nests of a row of the transportable receptacle (66), and to cause eggs from a second set of baskets dropping from the second set chutes to be received in the same row of the transposable receptacle in alternate nests as said second conveyor means moves said transportable receptacle along.

5. An egg packing apparatus as claimed in claim 4 wherein the transport means is travelling at a predetermined speed relative to the speed of second conveyor means (10).

6. An egg packing apparatus as claimed in claim 5 wherein said chutes have a rounded receiving end (68) and a length for rolling the egg pointed end down as the egg leaves the chute.

7. An egg packing apparatus as claimed in claim 6 wherein said chutes have lips (80) of a flexible material for contacting the blunt end of the egg.

8. An egg packing apparatus as claimed in claim 6 wherein said basket means (30) comprises three compartments and includes ten baskets, said first and second set of chutes (62, 64) each has three chutes and said transportable receptacle is a 6×5 flat.

9. An egg packing apparatus as claimed in claim 6 wherein said basket means (30) comprises one compartment and includes twelve baskets, said first and second set of chutes (62, 64) each has one chute and said transportable receptacle is a 2×6 carton.

10. An egg packing apparatus as claimed in claim 6 wherein said timing means includes a sensor means (31, 33) for generating a signal when one of said baskets has an egg in each compartment and said drive means is responsive to said signal synchronously driving said transport means and said second conveyor (10).

11. An egg packing apparatus as claimed in claim 10 wherein said drive means comprises a mechanical timing linkage between said transport means and said second conveyor (10) and said loading means and a clutch for intermittently driving said transport means and said second conveyor (10).

12. An egg packing apparatus as claimed in claim 11 wherein said transport means comprises a first and second endless chain (10) operatively mounted on each side of said path.

13. An egg packing apparatus as claimed in claim 12 wherein said path is endless comprising a vertical portion as the said basket means (30) passes said first conveyor (18) presenting said egg receiving opening substantially horizontal and a substantially horizontal portion as said basket means passes said unloading station presenting said egg receiving opening substantially inverted.

14. An egg packing apparatus as claimed in claim 13 wherein said apparatus further includes a denester (22) for storing a stack of said transportable receptacles (66) and depositing one of said stack of transportable receptacles onto the second conveyor means (10).

15. An egg packing apparatus as claimed in claim 14 wherein said sensor means is an optical sensor (31, 33) and said loading means includes a flap (29) pivotally connected between said guides (28) having a blocking position blocking said optical sensor when no egg is in the compartment and a flipped position unblocking said optical sensor when an egg is in the compartment.

16. An egg packing apparatus as claimed in claim 15 wherein said baskets means (30) being substantially tubular having an open framed construction comprising longitudinally extending ribs and circumferentially extending ribs spaced to retain eggs therein and having a longitudinally extending egg receiving opening.

17. An egg packing apparatus as claimed in claim 16 wherein said baskets means (30) are rigidly connected to said endless chains (110) at the ends of said baskets and eccentrically thereof.

18. An egg packing apparatus as claimed in claim 17 wherein said apparatus further includes an egg candler (82), an egg washer (84) and an egg oiler (86) spaced along said path.

19. An egg packing apparatus as claimed in claim 18 wherein said egg candler (82) includes an upper surface (88) spaced below said path for raising said eggs relative to said baskets means (30) for rolling said eggs as they travel through said egg candler (82) and a plurality of lights (90) to permit the eggs to be inspected as they roll therethrough.

20. An egg packing apparatus as claimed in claim 18 wherein said egg washer (84) includes a plurality of rotating brushes (92) for brushing said eggs, a plurality of sprays (94) for supplying a wash to said eggs and an air dryer (96) for supplying a dry air supply past the eggs for drying the eggs.

* * * * *